United States Patent [19]

Schrewe et al.

[11] Patent Number: 4,564,058

[45] Date of Patent: Jan. 14, 1986

[54] CONTROLLING THE FEEDING OF CASTING POWDER

[75] Inventors: Hans Schrewe, Duesseldorf; Fritz-Peter Pleschiutschnigg, Dortmund; Hans van Bonn, Duisburg; Karl Hölter; Gustav Wiegard, both of Witten, all of Fed. Rep. of Germany

[73] Assignees: Mannesmann AG, Duesseldorf; Gustav Wiegard Maschinenfabrik, Witten, both of Fed. Rep. of Germany

[21] Appl. No.: 59,266

[22] Filed: Jul. 20, 1979

[30] Foreign Application Priority Data

Jul. 31, 1978 [DE] Fed. Rep. of Germany ..... 2833867

[51] Int. Cl.[4] ..... B22D 27/00

[52] U.S. Cl. ..... 164/72; 164/154

[58] Field of Search ..... 164/4, 154, 72, 73, 164/418, 449, 414, 413, 155; 406/12, 90; 73/355 R

[56] References Cited

U.S. PATENT DOCUMENTS

| | | | |
|---|---|---|---|
| 1,318,516 | 10/1919 | Wallis et al. | 73/355 |
| 2,743,492 | 5/1956 | Easton | 164/449 X |
| 2,824,346 | 2/1958 | Osborn, Jr. | 164/4 |
| 3,343,591 | 9/1967 | Lorang | 164/155 |
| 3,933,394 | 1/1976 | Klein et al. | 406/90 |

FOREIGN PATENT DOCUMENTS

| | | | |
|---|---|---|---|
| 2292539 | 6/1976 | France | 164/155 |

*Primary Examiner*—Nicholas P. Godici

*Attorney, Agent, or Firm*—Ralf H. Siegemund

[57] ABSTRACT

Casting powder is to be fluidized for feeding to a mold for continuous casting. The gas flow providing the fluidization is controlled in response to bath surface temperature, monitored by means of a curved copper sheet, serving as radiation detector. A thermofeeler is attached to the sheet and controls a pneumatic control circuit for the fluidization gas.

4 Claims, 3 Drawing Figures

CONTROLLING THE FEEDING OF CASTING POWDER

BACKGROUND OF THE INVENTION

The present invention relates to controlling the feeding of casting powder into a mold for continuous casting.

It is common practice to feed a casting powder of the mold for continuous casting during casting thereof. The rate of feeding per unit time must bear a particulate relation to the casting speed and to the metal throughput so that the powder can fulfill its function which is the production of lubricating slag. Also, powder additives are used for additional metalurgical purposes. Thus, one should meter and control the feeding of casting to the mold.

Adding the powder poses the problem of dust development, which is an undesirable side effect, to be suppressed as much as possible. To achieve this, some of us have suggested to fluidize the casting powder so that, indeed, a controlled flow as far as the powder itself is concerned can be provided under conditions which minimize and even avoid dust development. (Ser. No. 025,581, filed Mar. 30, 1979.)

A problem exists with regard to the quantitative metering of the powder and the rate of application. German printed patent application No. 24,25,381 describes a control device for casting powder application operating in response to bath surface temperature. The surface temperature of the molten metal is, indeed, an indicator for the requisite amount of powder needed in any instant. Unfortunately, measuring the surface temperature of the bath of, e.g., molten steel is quite difficult on account of the extremely rugged operating conditions. There is a need for a reliable mode and manner to ascertain the surface temperature of the mold bath so that the casting powder feeding can reliably be controlled in accordance with the measured value.

DESCRIPTION OF THE INVENTION

It is an object of the present invention to improve the control of the feeding of casting powder into a mold for continuous casting.

It is a specific object of the present invention to control feeding of fluidized casting powder onto the surface of the bath of molten metal in a mold for continuous casting.

In accordance with the preferred embodiment of the present invention, it is suggested to provide a sheet of metal above the mold to be heated by radiation from the entire bath surface in the mold, or at least from a representative portion thereof. The temperature of the sheet is detected, and the resulting measuring value is used to control the gas flow towards and for the powder fluidization. The device is characterized by simplicity and reliability in spite of the very tough operating conditions. The control operation is preferably carried out on the basis of pneumatics, using the powder fluidizing gas additionally for control purposes.

The preferred embodiment of the invention, the objects and features of the invention, and further objects, features and advantages thereof will be better understood from the following description taken in connection with the accompanying drawings.

DESCRIPTION OF THE DRAWINGS

Proceeding now to the detailed description of the drawings, FIG. 1 illustrates a storage bin 1, vessel, or container, for casting powder. Bin 1 is connected, for example, to a tundish 8 by means of pivots, joints, holders 2, or the like, which permit the bin to be shifted in a horizontal plane as well as up and down and which permit further pivoting of the bin on a horizontal axis and a vertical axis. Once adjusted, the position of bin 1 is usually maintained during casting.

Figure 1:
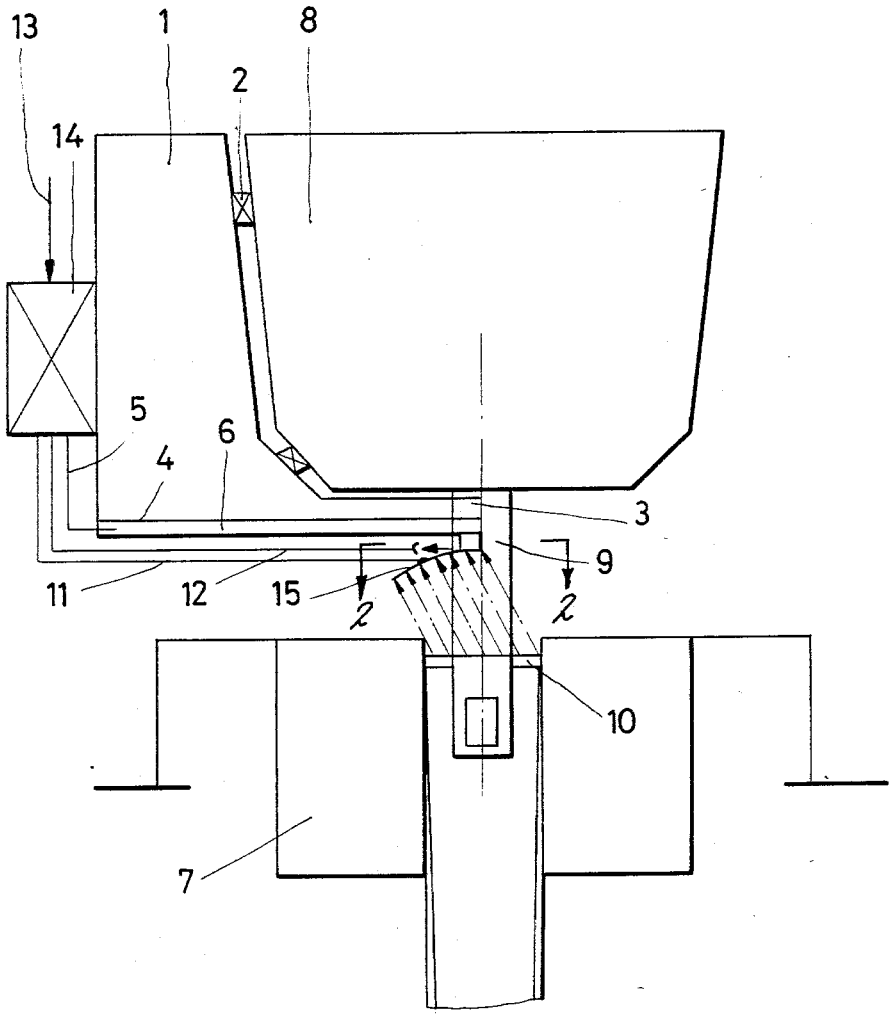
FIG. 1 is a schematic side and section view of equipment in accordance with the preferred embodiment of the invention.

Bin 1 is provided with an outlet spout, or duct, 3, being centrally located above the open cavity of a mold 7 for continuous casting. Powder can, thus, be applied by this applicator to the otherwise exposed surface of the bath of molten metal (e.g., steel) in the mold. As a consequence, a layer 10 of slag is formed on that surface, covering it in its entirety. Maintaining an adequately thick layer of slag is the purpose of applying casting powder to the mold.

The spout portion as well as the bin as a whole is provided with a second, bottom-like horizontal partition 4. This partition is provided with a plurality of apertures, and space 6 underneath serves as plenum chamber. The chamber is closed, except for (a) the apertures in partition 4, and (b) the opening end of a gas duct 5, which pressurizes the plenum chamber. The gas as discharged through partition 4 into the bin above the partition fluidizes the powder in the bin which, thus, is caused to flow as a fluid out of opening 3. This way, the powder is discharged and fed to mold 7 with little or no development of dust.

A curved sheet 15 is disposed underneath outlet opening 3 and the front portion of the outlet duct for powder. This sheet is isolated from the rest of the system. The sheet is made of metal and has a high thermal conductivity (e.g. copper). As illustrated, the curvature and position of sheet 15 is such that its concave portion faces the mold cavity. Thus, the sheet will receive radiation from the entire surface of the bath in the mold and from the slag thereon.

A thermofeeler or detector 11 is affixed to the sheet to measure its temperature. Detector 11 is electrically connected to a control circuit 14 by means of a connection 11'. The thermofeeler is preferably affixed to sheet 15 so that the sheet protects the feeler against any direct exposure to the molten metal.

A second temperature sensing device, 12, is disposed a little above sheet 15 and measures the immediate ambient temperature above the sheet. A connection 12' leads from detector 12 also to controller 14. Again, one can see that metal plate 15 serves also as a shield of this thermofeeler as against the molten metal.

Controller 14 is also connected to feeder line 5 for gas and controls the flow of gas as used for utilizing the powder in bin 1. Reference numeral 13 denotes schematically the power supply for the controller to provide thereto compressed gas and, possibly, electrical energy. Some electrical power is, of course, needed for operating the thermofeelers. Presently, however, we propose the primary use of pneumatics for control purposes as will be described shortly.

Figure 2:
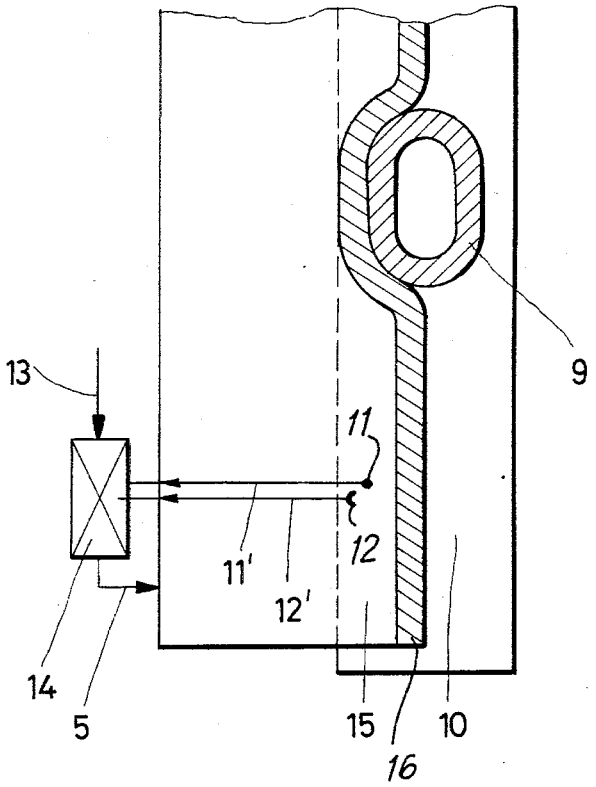
FIG. 2 is a view taken in a plane indicated by line 2—2 in FIG. 1.

FIG. 2 illustrates schematically the configuration of sheet 15 as it bypasses feeder pipe 9 for the molten metal. Moreover, one can readily see that a ledge portion 16 is provided to connect the sheet to the spout. The connection should provide for thermal isolation, so that the temperature of shield 15 is primarily determined by radiation from the hot metal and any slag in the mold.

Figure 3:
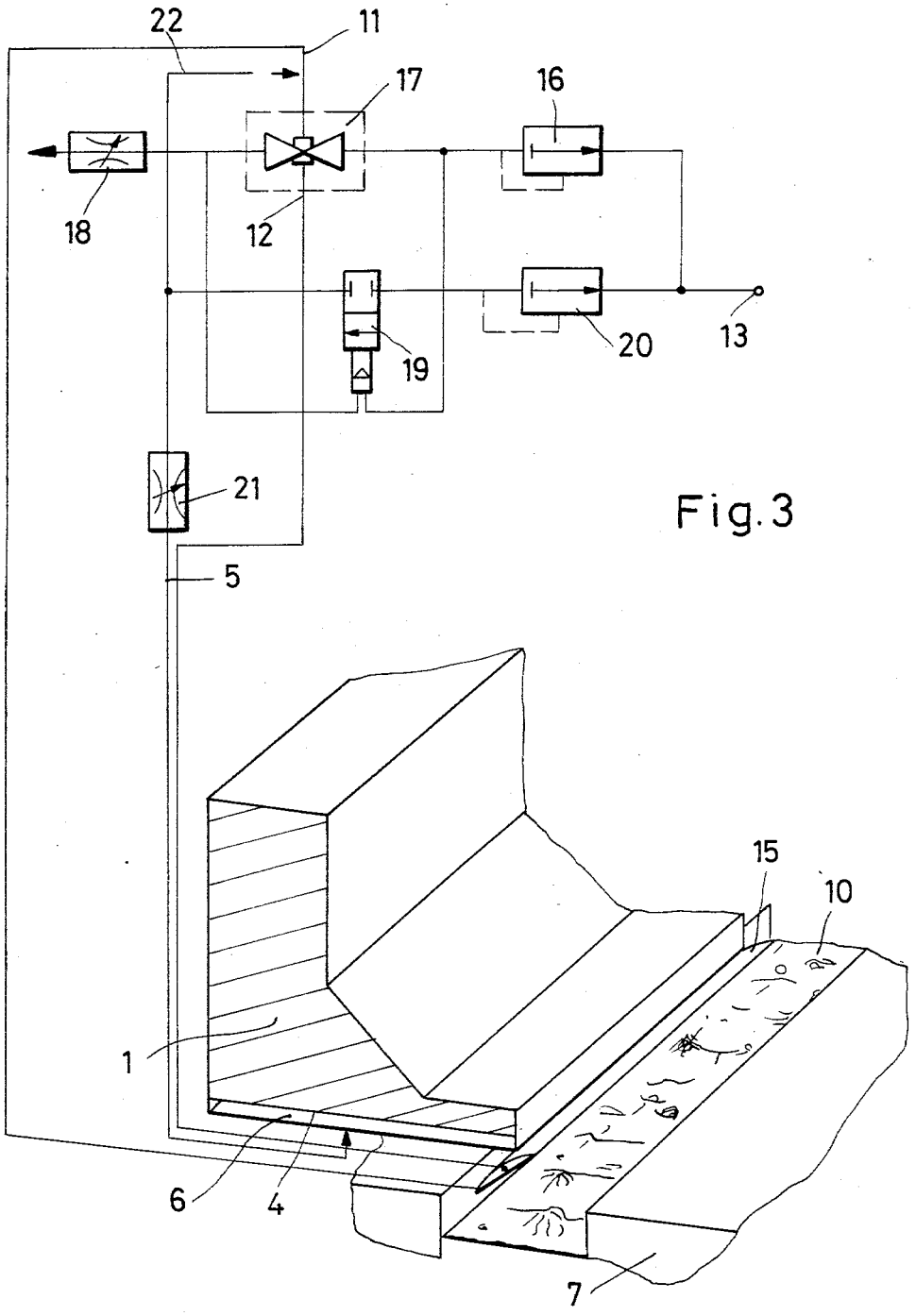
FIG. 3 is a circuit diagram for a pneumatic control circuit as used in the system shown in FIGS. 1 and 2.

Turning now to the control circuit shown in FIG. 3, a servovalve 16 taps the pneumatic power line 13 to establish a constant pressure for further use in the control circuit. Particularly, a valve 17 receives such constant operating pressure to provide a controlled pressure in response to electrical signals, respectively derived from the two sensors 1 and 12.

A valve 20 is connected to line 13 in parallel to valve 16. Valve 20 may also be a servovalve to establish a particular rate of flow for gas, ultimately into line 5. The maximum rate of flow may be chosen so that the fluidization of powder provided by the gas will never be so vigorous that the powder is converted into a powder cloud.

The output of valve 17 is connects to a valve 18 which has a particular threshold for response, to bleed off, or not to bleed off, gas as received from valve 17. The output duct from the latter is also connected to a valve 19 which provides for power control in the gas supply to feeder line 5 for pressurizing plenum chamber 6. Valve 19 is pneumatically controlled by the output as effective on valve 17. Additionally, the constant pressure from valve 16 serves as reference on valve 19.

Valve 20 provides for a particular value of gas flow from feeder line 13, ultimately chamber 6, except for the control action of valve 19. The output gas flow valve 19 is split into two components; one being the supply for line 5 and plenum 6. The other component serves as a coolant for thermofeeler 11 and its connection 11'. A valve 21 is provided in one of the two output paths from valve 19 to control and to adjust the relative proportion of the two gas flow components.

The system as described operates as follows. In the normal course of casting, molten steel pours from tundish 8 through pipe 9 into mold 7. Thermofeeler 11 measures the temperature of sheet 15, which is heated by radiation from the surface of the bath of molten metal in the mold. Depending upon the contour and dimensions of sheet 15, part of, or all of, the bath surface is put under thermal surveillance in this manner. In view of the usual symmetry in the casting mold, only half of the bath's surface needs to be observed to gain a true representation of the whole; one of the (vertical) planes of symmetry may serve here as the dividing line. The concavity of sheet 15 aids in the capture of as much radiation as possible to speed up the response to any changes.

The two signals representing detected bath surface temperature and ambient (12) are applied to valve 17 which is operated by any resulting difference to open a passage for control gas which, in turn, operates pneumatically power valve 19. Valve 18 serves as threshold device in the sense that it remains open for small pressure valves (small temperature differential) to suppress response of power valve 19. Thus, the latter is opened only when the temperature differential exceeds a certain amount; the bath surface becomes too hot. Now, gas flows into line 5 and powder in bin 1 is fluidized due to pressure increase in plenum 6. Powder is now caused to flow out of bin 1 onto the bath covering it and establishing slag layer 10. As the thermal radiation from the slag-covered bath surface drops, the pouring of powder is reduced or even stopped. Under stable dynamic conditions, one will readily obtain and retain a particular slag layer thickness, resulting in a particular temperature differential sufficient to maintain a powder flow that replenishes the slag layer and offsets the outflow of slag into the mold along the wall and/or other processes of powder consumption. The ambient temperature serves as reference to render the control conditions independent from temperature changes not attributable to changes in the slag layer on the bath.

In some cases, one may wish to operate in an ON-OFF mode so that the control characteristics of the elements are chosen to provide maximum powder flow for a short period, building up powder and slag followed by a pause of no powder flow. Only after it has been consumed, can one can cause another quantity to be added.

The control can be carried out electrically or electronically, preferably somewhat remote from the casting machine. Sheet 15 may be planar or differently curved, or its convex side may face the mold to obtain a different radiation balance. One can also construct it as a bottom portion for the bin.

The invention is not limited to the embodiments described above, but all changes and modifications thereof not constituting departures from the spirit and scope of the invention are intended to be included.

We claim:

1. Apparatus for the control of feeding casting powder to a mold for continuous casting, there being a storage bin for powder having an outlet and a perforated bottom underneath of which is disposed a plenum chamber, the apparatus comprising:

gas feeder means connected to the plenum chamber;

pneumatic control means disposed in the gas feeder means to adjust a rate of flow of gas through the feeder means, thereby adjusting the pressure in the plenum chamber and the amount of gas forced into the bin to cause fluidization of powder therein and fluid-like outflow of powder onto molten metal in the mold;

a metal sheet disposed adjacent to the surface of molten metal in the mold and being heated by radiation therefrom; and a temperature-sensitive element operatively connected to the sheet for being heated by the sheet, having, in turn, been heated by said radiation, and providing a signal representing accordingly the surface temperature of the content of the mold, the element being connected to the control means for causing the control means to provide the adjustment in response to said signal.

2. Apparatus as in claim 1, said sheet being made of copper.

3. Apparatus as in claim 1, said temperature-sensitive element being affixed to the sheet on a side facing away from the mold cavity.

4. Apparatus as in claim 1, said sheet being affixed to said bin.

* * * * *